US005253855A

United States Patent [19]

Torisawa et al.

[11] Patent Number: 5,253,855

[45] Date of Patent: Oct. 19, 1993

[54] SHEET FEEDING DEVICE

[75] Inventors: Nobuyuki Torisawa; Norikazu Soga, both of Minami-ashigara, Japan

[73] Assignee: Fuji Photo Film Co., Ltd., Kanagawa, Japan

[21] Appl. No.: 805,950

[22] Filed: Dec. 12, 1991

[30] Foreign Application Priority Data

| | | | |
|---|---|---|---|
| Dec. 13, 1990 | [JP] | Japan | 2-401926 |
| Jun. 20, 1991 | [JP] | Japan | 3-148987 |
| Jun. 20, 1991 | [JP] | Japan | 3-148988 |

[51] Int. Cl.[5] ..... B65H 3/44

[52] U.S. Cl. ..... 271/9; 271/11; 271/107; 271/265

[58] Field of Search ..... 271/9, 110, 145, 157, 271/11, 107, 265

[56] References Cited

U.S. PATENT DOCUMENTS

| | | | |
|---|---|---|---|
| 4,018,033 | 4/1977 | Schmidt . | |
| 4,337,935 | 7/1982 | Sawada et al. | 271/9 |
| 4,523,752 | 6/1985 | Kigawa et al. | 271/9 |
| 4,763,891 | 8/1988 | Kodama | 271/157 |
| 4,872,660 | 10/1989 | Kameyama et al. | 271/9 |
| 4,991,830 | 2/1991 | Yamanaka et al. | 271/9 |

FOREIGN PATENT DOCUMENTS

| | | | |
|---|---|---|---|
| 0415425 | 3/1991 | European Pat. Off. . | |
| 3027146 | 2/1981 | Fed. Rep. of Germany | 271/9 |
| 198239 | 11/1984 | Japan | 271/9 |
| 124449 | 6/1986 | Japan | 271/9 |
| 124450 | 6/1986 | Japan | 271/9 |
| 171720 | 7/1988 | Japan | 271/157 |
| 2069467 | 8/1981 | United Kingdom . | |

OTHER PUBLICATIONS

Patent Abstract of JP-A-1 281 242, Nov. 13, 1989.

*Primary Examiner*—Robert P. Olszewski
*Assistant Examiner*—Steven M. Reiss
*Attorney, Agent, or Firm*—Sughrue, Mion, Zinn Macpeak & Seas

[57] ABSTRACT

The present invention relates to a device for feeding sheets, one by one, to an automatic photographic processor or the like. The sheet feeding device generally includes a suction pad for taking out an uppermost sheet of stacked sheets stored in a sheet placement unit, a delivery mechanism for delivering the uppermost sheet to a sheet discharge port, a shutter mechanism used to open and close the sheet discharge port, a sheet insertion slot for directly introducing an extra sheet other than said stacked sheets to the sheet discharge port, a cover capable of opening and closing the sheet insertion slot, a magazine capable of accommodating a roll of sheet therein and capable of being disposed in the sheet insertion slot, a swingable plate having one end coupled to a drive source and the other end brought into engagement with the shutter mechanism so as to open and close the shutter mechanism, and a sensor for detecting angular positions of the swingable plate. Alternatively, the shutter mechanism may be opened and closed using a rack and pinion system.

14 Claims, 13 Drawing Sheets

SHEET FEEDING DEVICE

BACKGROUND OF THE INVENTION

1. Field of the Invention

The present invention relates to a device for feeding sheets, one by one, to an automatic photographic processor, for example.

2. Description of the Related Art

A sheet feeding device is used to take out sheets such as photographic light-sensitive mediums after an image has been exposed thereon, one by one, to feed to an automatic photographic processor.

In a conventional sheet feeding device, a stack of sheets is loaded in a magazine or a sheet placement unit from a sheet loading opening. Thereafter, an uppermost sheet of the stacked sheets is attracted under suction by a suction cup or pad (sheet separating means) to remove the sheet from the sheet placement unit. Then, the uppermost sheet is delivered to a sheet discharge port by a delivering means, and a shutter for opening and closing the sheet discharge port is opened, the uppermost sheet being transported toward the automatic photographic processor from the sheet discharge port.

While the stacked sheets are being fed one by one to the automatic photographic processor by the sheet feeding device, there are often cases where development of another sheet other than the stacked sheets is urgently required by the automatic photographic processor or where the sheet feeding device fails. In such cases, the conventional sheet feeding device is disengaged from the automatic photographic processor, and the sheet is manually inserted into the automatic photographic processor. Alternatively, the delivering means in the sheet feeding device is manually operated to feed sheets one by one to the automatic photographic processor.

In the conventional apparatus referred to above, however, a process for disengaging the sheet feeding device from the automatic photographic processor or a process for manually operating the delivering means is extremely cumbersome, and the entire sheet feeding process cannot efficiently be carried out.

In addition, failure in a mechanism for opening and closing the shutter may make it impossible to feed sheets one by one to the automatic photographic processor.

Further, when the sheet feeding device is activated, a cover for opening and closing the sheet loading opening is opened for loading the stacked sheets in the device. The cover is then closed so as to be light-tight and thereafter an operation switch is actuated to start the device. Thus, the operation of the device, as described above, is cumbersome and complicated.

When a new sheet stack is introduced from a sheet loading opening after a residual quantity of stacked sheets is depleted, and the sheet feeding device is operated again, or, when malfunctions of the sheet separating means such as clogging of sheets or double sheet feeding occur, all of the sheets must be removed, and the sheet feeding device re-actuated. In this case, the same processes as described above are required, which results in cumbersome operation of the sheet feeding device.

SUMMARY OF THE INVENTION

It is a principal object of the present invention to provide a sheet feeding device capable of easily and efficiently feeding a sheet when the sheet is required to be urgently processed by an automatic photographic process as, for example, when stacked sheets are to be fed one by one to the automatic photographic processor or the like.

It is another principal object of the present invention to provide a sheet feeding device capable of instantly coping with failure of the device.

It is a further principal object of the present invention to provide a sheet feeding device wherein either a cover for opening and closing a sheet loading opening or a cover for opening and closing a sheet insertion slot is closed in such a manner that the device can automatically be actuated so that the operation of the device can be simplified.

It is another object of the present invention to provide a device for feeding sheets one by one, the device comprising sheet separating means for taking out an uppermost one of stacked sheets stored in a sheet placement unit, means for delivering the uppermost sheet to a sheet discharge port, shutter means capable of opening and closing the sheet discharge port, and a sheet insertion slot for directly introducing a sheet through the sheet discharge port into an automatic photographic processor or the like.

It is a further object of the present invention to provide a device further including a cover capable of opening and closing the sheet insertion slot.

It is a still further object of the present invention to provide a device further including a magazine capable of accommodating a roll of sheet therein and capable of being disposed in the sheet insertion slot.

It is a still further object of the present invention to provide a device further including a swingable plate having one end coupled to a drive source and the other end brought into engagement with the shutter means so as to open and close the shutter means.

It is a still further object of the present invention to provide a device further including a sensor for detecting angular positions of the swingable plate.

It is a still further object of the present invention to provide a device wherein the shutter means comprises a shutter plate for opening and closing the sheet discharge port, a grip mounted on the shutter plate, for manually displacing the shutter plate, a drive source for automatically displacing the shutter plate, and means for transmitting a driving force from the drive source to the shutter plate.

It is a still further object of the present invention to provide a device wherein the transmitting means comprises a pair of pinions coupled to the drive source, and a pair of racks meshing with the pinions and fixed to the shutter plate.

It is a still further object of the present invention to provide a device further including a magazine capable of accommodating a roll of sheets therein and capable of being disposed in the sheet placement unit.

It is a still further object of the present invention to provide a device for feeding sheets one by one, the device comprising a sheet loading opening for loading stacked sheets in a sheet placement unit, sheet separating means for taking out an uppermost sheet of the stacked sheets in the sheet placement unit, means for delivering the uppermost sheet to a sheet discharge port, shutter means capable of opening and closing the sheet discharge port, a sheet insertion slot for directly inserting another extra sheet other than the stacked sheets through the slot into the sheet discharge port, means for opening and closing the sheet loading opening, loading detecting means for detecting whether or not the means for opening and closing the sheet loading opening is opened or closed, and a control unit for actuating the feeding device when the loading detecting means detects that the means for opening and closing the loading opening is closed.

It is a still further object of the present invention to provide a device for feeding sheets one by one, the device comprising a sheet loading opening for loading stacked sheets in a sheet placement unit, sheet separating means for taking out an uppermost sheet of the stacked sheets from the sheet placement unit, means for delivering the uppermost sheet to a sheet discharge port, shutter means capable of opening and closing the sheet discharge port, a sheet insertion slot for directly inserting another extra sheet other than the stacked sheets through the slot into the sheet discharge port, means for opening and closing the sheet insertion slot, insertion detecting means for detecting whether or not the means for opening and closing the sheet insertion slot is opened or closed, and a control unit for actuating the sheet feeding device when the insertion detecting means detects that means for opening and closing the sheet insertion slot is closed.

It is a still further object of the present invention to provide a device for feeding sheets one by one, the device comprising a sheet loader for loading stacked sheets in a sheet placement unit, sheet separating means for taking out an uppermost sheet of the stacked sheets from the sheet placement unit, means for delivering the uppermost sheet to a sheet discharge port, shutter means capable of opening and closing the sheet discharge port, a sheet insertion slot for directly inserting another extra sheet other than the stacked sheets through the slot into the sheet discharge port, means for opening and closing the sheet loading opening, loading detecting means for detecting whether or not the means for opening and closing the sheet loading opening is closed, means for opening and closing the sheet insertion slot, insertion detecting means for detecting whether or not the means for opening and closing the sheet insertion slot is opened, and a control unit for actuating the sheet feeding device when both of the loading detecting means and the insertion detecting means detect that the means for opening and closing the sheet loading opening and the means for opening and closing the sheet insertion slot are, respectively, closed.

It is a still further object of the present invention to provide a device further including means for displaying an error thereon when malfunctions in sheet feeding operation of the sheet separating means are detected.

It is a still further object of the present invention to provide a device further including means for detecting the residual quantity of stacked sheets loaded in the sheet placement unit, and means for indicating that the residual quantity of the sheets becomes is zero.

It is a still further object of the present invention to provide a device further including means for placing each of the operative parts of the sheet feeding device in a standby state, after at least one cycle of sheet feeding operation of a sheet of stacked sheets stored in the sheet placement unit with the feeding device, when urgent sheet processing is needed or when the insertion detecting means detects that the means for opening and closing the sheet insertion slot is opened while the stacked sheets stored in the sheet placement unit are being fed one by one.

The above and other objects, features and advantages of the present invention will become apparent from the following description and the appended claims, taken in conjunction with the accompanying drawings in which preferred embodiments of the present invention are shown by way of illustrative example.

DETAILED DESCRIPTION OF THE PREFERRED EMBODIMENTS

Figure 1:
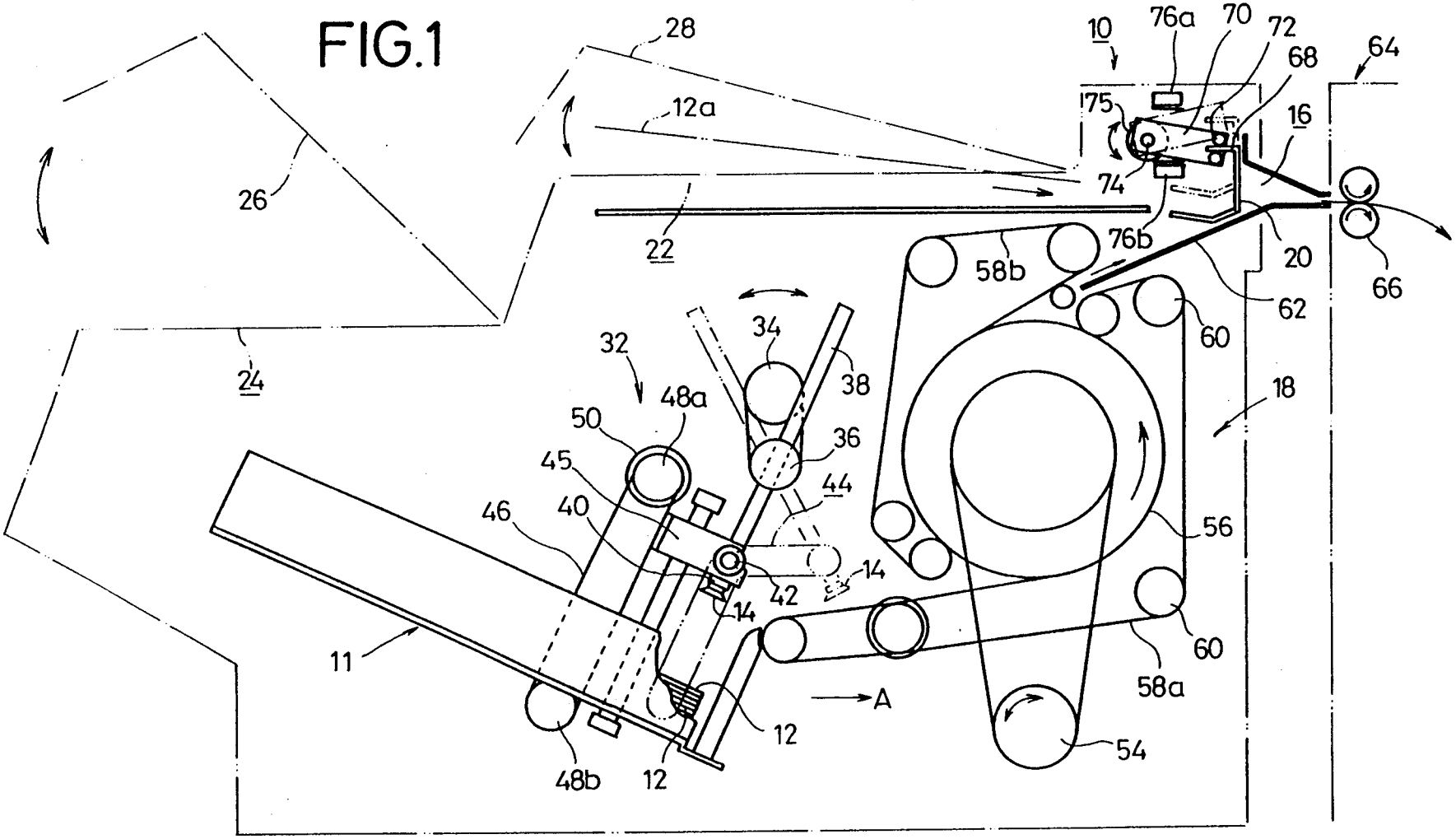
FIG. 1 is a view schematically showing the structure of a sheet feeding device according to a first embodiment of the present invention.

Referring to FIG. 1, numeral 10 indicates a device for feeding sheets one by one, according to a first embodiment of the present invention. The sheet feeding device 10 basically comprises a suction cup or pad (sheet separating means) 14 for taking out, one by one, stacked photographic light-sensitive mediums (sheets) 12 on which images have been exposed and which are stored in a sheet placement portion or unit 11, a delivering means 18 for delivering the uppermost photographic light-sensitive medium 12 thus taken out to a sheet discharge port, i.e., an outlet 16, a shutter means 20 capable of opening and closing the outlet 16, and a sheet insertion slot 22 for directly inserting a photographic light-sensitive medium 12*a* other than the stacked mediums 12, through the insertion slot 22 into the outlet 16.

Figure 2A:
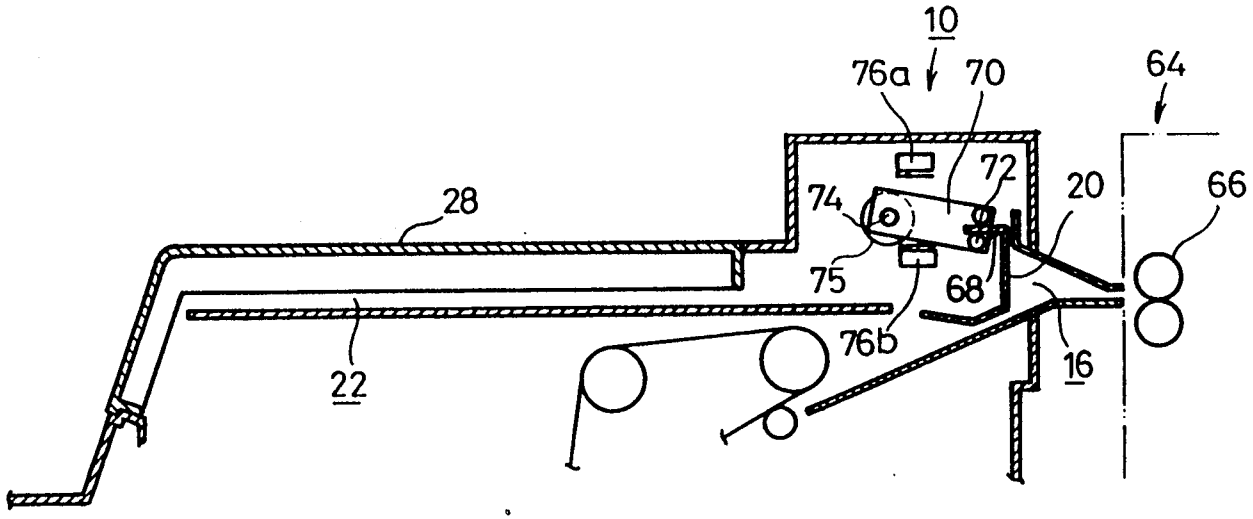
FIG. 2 is a vertical cross-sectional view for showing the operation of the sheet feeding device.
Figure 2B:
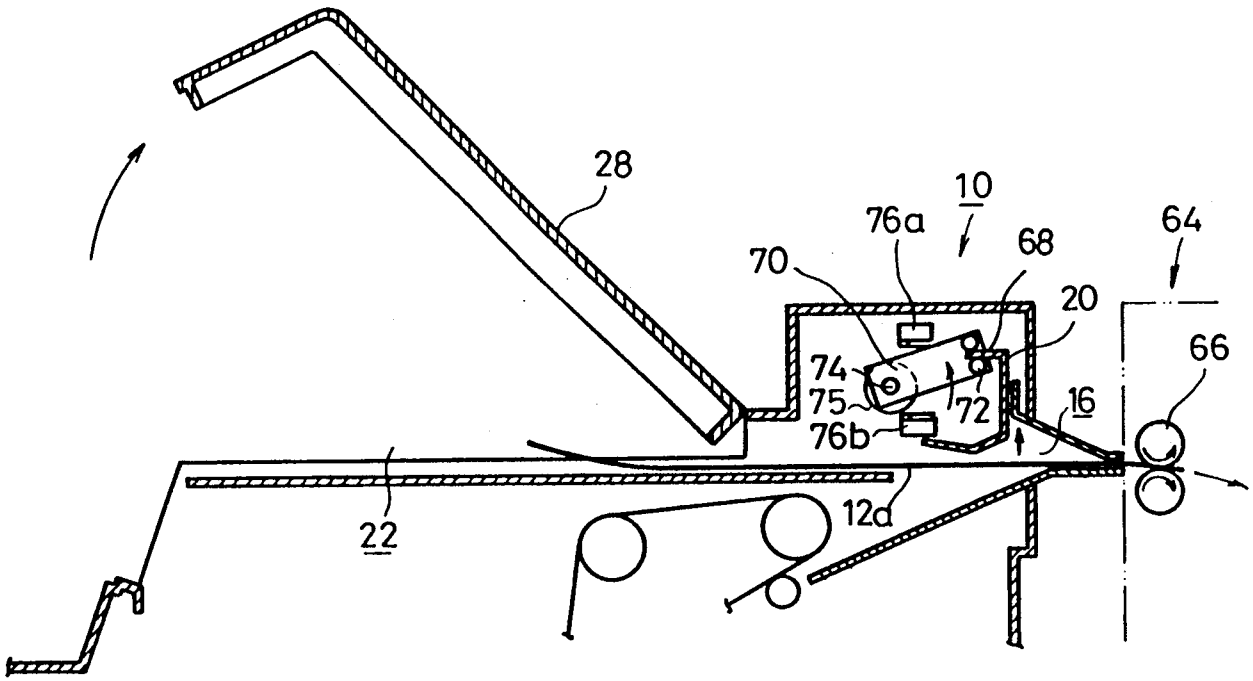

A first cover 26 capable of opening and closing a sheet charging or loading opening 24 for loading stacked photographic light-sensitive mediums 12 in the sheet placement unit 11, and a second cover 28 capable of opening and closing the sheet insertion slot 22 are mounted on the sheet feeding device 10 (see FIG. 1 and FIGS. 2*a* and 2*b*).

The suction pad 14 is movable and swingable toward and away from the stacked photographic light-sensitive mediums 12 by a drive means 32. The drive means 32 has a rotative drive source 34 and a guide bar 38 is slidable inserted into a rotatable shaft 36 which is coupled to the rotative drive source 34. A holder 40 is fixedly mounted on the guide bar 38 and both ends of a rod 42 attached to the guide bar 38 are inserted into substantially L-shaped guide grooves 44. A movable member 45 engaging one of the ends of the rod 42 is fixedly mounted on a belt 46. The belt 46 is wound around a pair of pulleys 48*a*, 48*b* and the pulley 48*a* is coupled to a rotative drive source 50.

An shown in FIG. 1, the delivering means 18 has a relatively large-diameter drum 56 rotatably driven by a rotative drive source (pulse motor) 54. The outer peripheral surface of the drum 54 contacts with a first belt 58*a* and a second belt 58*b*, which are wound around a plurality of rollers 60. These belts 58*a*, 58*b* are driven by the drum 54 when it rotates. A photographic light-sensitive medium 12 is fed through a guide plate 62 in the vicinity of the outlet 16 from the outlet 16 and then transported by a pair of delivery rollers 66 into an automatic photographic processor 64.

In the drawing, the shutter means 20 has a horizontally-extending engaging portion 68 which is engaged with pins 72 fixed to one end of a swingable plate 70. The swingable plate 70 has a rotatable shaft 74 fixed to the other end thereof and coupled to a rotative drive source 75. Limit switches 76*a*, 76*b* as sensors for detecting angular positions of the swingable plate 70 are located on the both sides of the swingable plate 70 at the upper and lower portions thereof to determine whether the shutter means 20 is in an opened state or in a closed state.

The operation of the sheet feeding device will now be described below.

The first cover 26 is swung upwardly to open the sheet loading opening 24. Thereafter, a plurality of photographic light-sensitive mediums 12 in a stacked state is loaded in the sheet placement unit 11 through the sheet loading opening 24.

Then, the pulleys 48*a*, 48*b*, are rotated by the driving force of the rotative drive source 50 of the drive means 32 to displace the movable member 45 the rod 42 toward the uppermost photographic light-sensitive medium 12 along the guide grooves 44. Thereafter, the suction pad 14 starts to suck the uppermost photographic light-sensitive medium 12 at a given vertical position, so that the suction pad 14 attracts and holds the uppermost photographic light-sensitive medium 12 under suction.

The rotative drive source 50 is then reversed to elevate the rod 42 along the guide grooves 44, and the uppermost photographic light-sensitive medium 12 which has been attracted and held by the suction pad 14 is upwardly taken out from the stacked photographic light-sensitive mediums 12. When the rod 42 reaches the corner of each of the guide grooves 44, the rotative drive source 50 is deenergized. The rotative drive source 34 is then energized to rotate the rotatable shaft 36, thereby turning the rod 42 in a given angular range (see the alternate long and two short dash chain line shown in FIG. 1). Consequently, the uppermost photographic light-sensitive medium 12 which has been attracted and held by the suction pad 14 is fed toward the delivering means 18.

The suction pad 14 is inactivated to release the photographic light-sensitive medium 12. The rotative drive source 54 of the delivering means 18 is energized to rotate the drum 56 in the direction indicated by the arrow, and the photographic light-sensitive medium 12 is transported by the drum 56, the first belt 58*a* and the second belt 58*b* to a given angular position. Then, the rotative drive source 54 is energized to rotate the drum 56 in the direction opposite to the direction indicated by the arrow to deliver the photographic light-sensitive medium 12 supported on the drum 56 through the outlet 16 to the automatic photographic processor 64 along the guide plate 62. At this time, the swingable plate 70 swings upwards in unison with the rotatable shaft 74 by the rotative drive source 75 to displace the shutter means 20 upwards so as to oppose the outlet 16 by the pins 72 and the engaging portion 68 thereby leaving the outlet 16 open.

The photographic light-sensitive medium 12 is transported into the automatic photographic processor 64 along a predetermined path by the rotation of the delivery rollers 66 to be subjected to a developing process.

After the photographic light-sensitive medium 12 has been delivered to the automatic photographic processor 64 from the sheet feeding device 10, the rotative drive source 75 coupled to the rotatable shaft 74 is reversed to swing the swingable plate 70 in the downward direction to cause the pins 72 and the engaging portion 68 to move the shutter means 20 downwardly. Thus, the outlet 16 is closed. Accordingly, the shutter prevents gas produced in the automatic photographic processor 64 from entering into the sheet feeding device 10.

While stacked photographic light-sensitive mediums 12 stored in the sheet placement unit 11 are being fed one by one to the automatic photographic processor 64 by the suction pad 14 and the delivering means 18, it is often necessary to immediately or urgently develop another extra photographic light-sensitive medium 12*a*. In the present embodiment, after the drive means 32 and the delivering means 18 have been inactivated, the second cover 28 is swung upwardly to open the sheet insertion slot 22, and the rotative drive source 75 is energized to cause the rotatable shaft 74 to turn the swingable plate 70 to displace the shutter means 20 upwardly, for opening the outlet 16. The photographic light-sensitive medium 12*a* is inserted into the sheet feeding device 10 through the sheet insertion slot 22, and the leading end of the photographic light-sensitive medium 12*a* is directly inserted into the outlet 16 (see FIG. 2*b*). Therefore, the leading end of the photographic light-sensitive medium 12*a* is held between the delivery rollers 66 in the automatic photographic processor 64. Then, the delivery rollers 66 are rotated to feed the photographic light-sensitive medium 12*a* to a developing station.

According to the present embodiment, as described above, the second cover 28 of the sheet feeding device 10 is opened, thereby enabling the extra photographic light-sensitive medium 12*a* to be directly inserted into the outlet 16 through the sheet insertion slot 22. Therefore, the extra photographic light-sensitive medium 12*a* can rapidly be fed to the automatic photographic processor 64, so that the photographic light-sensitive medium 12*a* can be efficiently processed. It is also unnecessary to drive the sheet feeding device 10 when an extra photographic light-sensitive medium 12*a* is inserted into the outlet 16 through the sheet insertion slot 22. Thus, since the extra photographic light-sensitive medium 12*a* can easily be fed to the automatic photographic processor 64 even if the sheet feeding device 10 fails, the photographic light-sensitive medium 12*a* can be rapidly processed.

In the present embodiment, the rotatable shaft 74 coupled to the rotative drive source 75 is rotated to turn the singable plate 70 upwardly and downwardly, to open and close the shutter means 20. However, the shutter means 20 can be opened or closed by other mechanical means such as a link mechanism or a gear train operable with the opening and closing operations of the second cover 28.

In the present embodiment, another extra photographic light-sensitive medium 12*a* is used as the sheet to be inserted into the sheet feeding device 10 through the slot 22. However, a roll of photographic light-sensitive medium 12*b* may also be used as an alternative to the extra photographic light-sensitive medium 12*a* as shown in FIG. 3.

Figure 3:
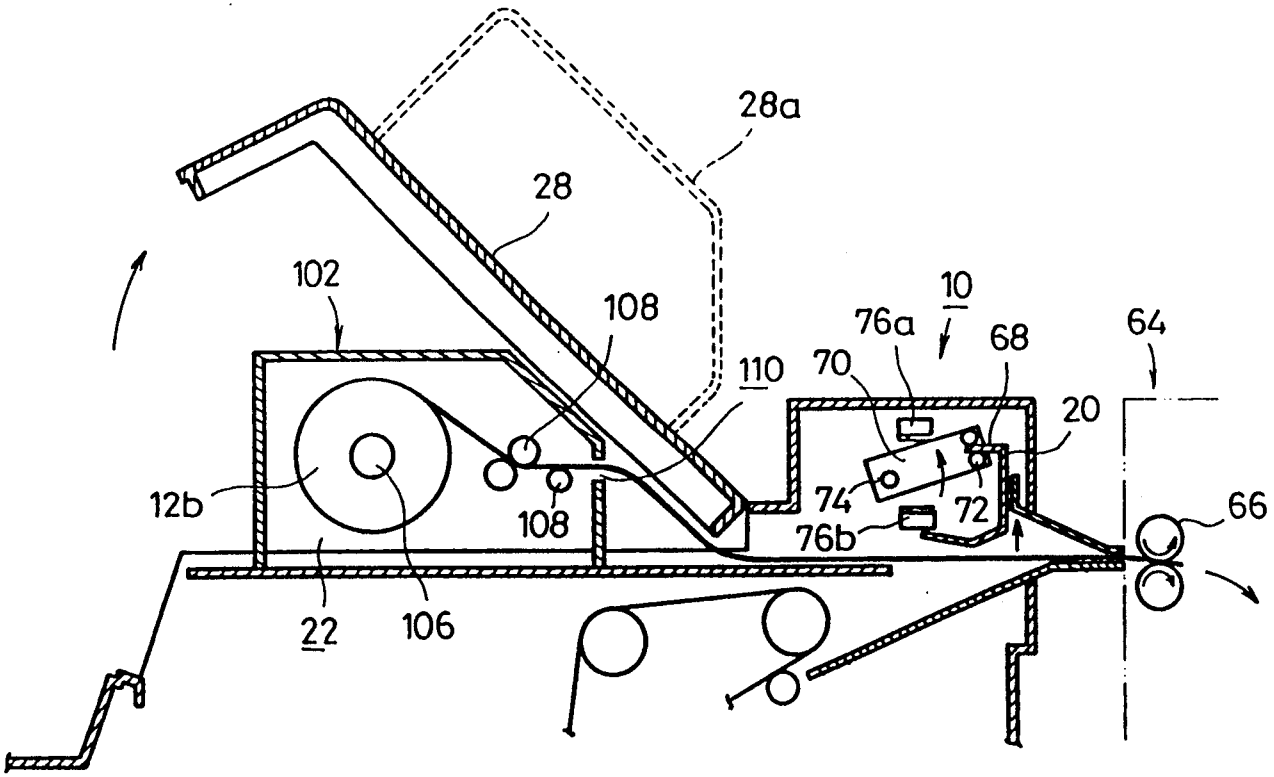
FIG. 3 is a vertical cross-sectional view showing the structure of an essential part of a modification of the sheet feeding device according to the first embodiment.

More specifically, designated at numeral 102 in FIG. 3 is a magazine used for a roll of photographic film. The photographic light-sensitive medium 12*b* is wound on a take-up spindle 106 in the form of a roll, and accommodated in the magazine 102 in a light-shieled state. The leading end of the roll of the photographic light-sensitive medium 12*b* is interposed between light-shielding rollers 108 and drawn through an opening 110.

The magazine 102 is placed in the sheet insertion slot 22 when the second cover 28 is being opened. Thereafter, the leading end of the photographic light-sensitive medium 12*b* is drawn from the magazine 102 so as to be interposed between the delivery rollers 66, and is transported into the automatic photographic processor 64 under the rotation of the delivery rollers 66. Thus, the roll of the photographic light-sensitive medium 12*b* can also be developed in place of the sheet-shaped photographic light-sensitive medium 12*a*. If a second opening and closing cover 28*a* having a concave portion, as indicated by the broken line in FIG. 3, in which the magazine 102 is accommodated is closed, the photographic light-sensitive medium 12*b* can be delivered into the automatic photographic processor 64 under daylight.

In these embodiments, the photographic light-sensitive mediums 12 which have already been exposed are fed one by one by the sheet feeding device 10. However, the sheet feeding device 10 may be applied to a case in which unexposed photographic light-sensitive mediums 12 are fed one by one to an image recording device.

A sheet feeding device according to a second embodiment of the present invention will now be described below in detail with reference to the accompanying drawings.

Figure 4:
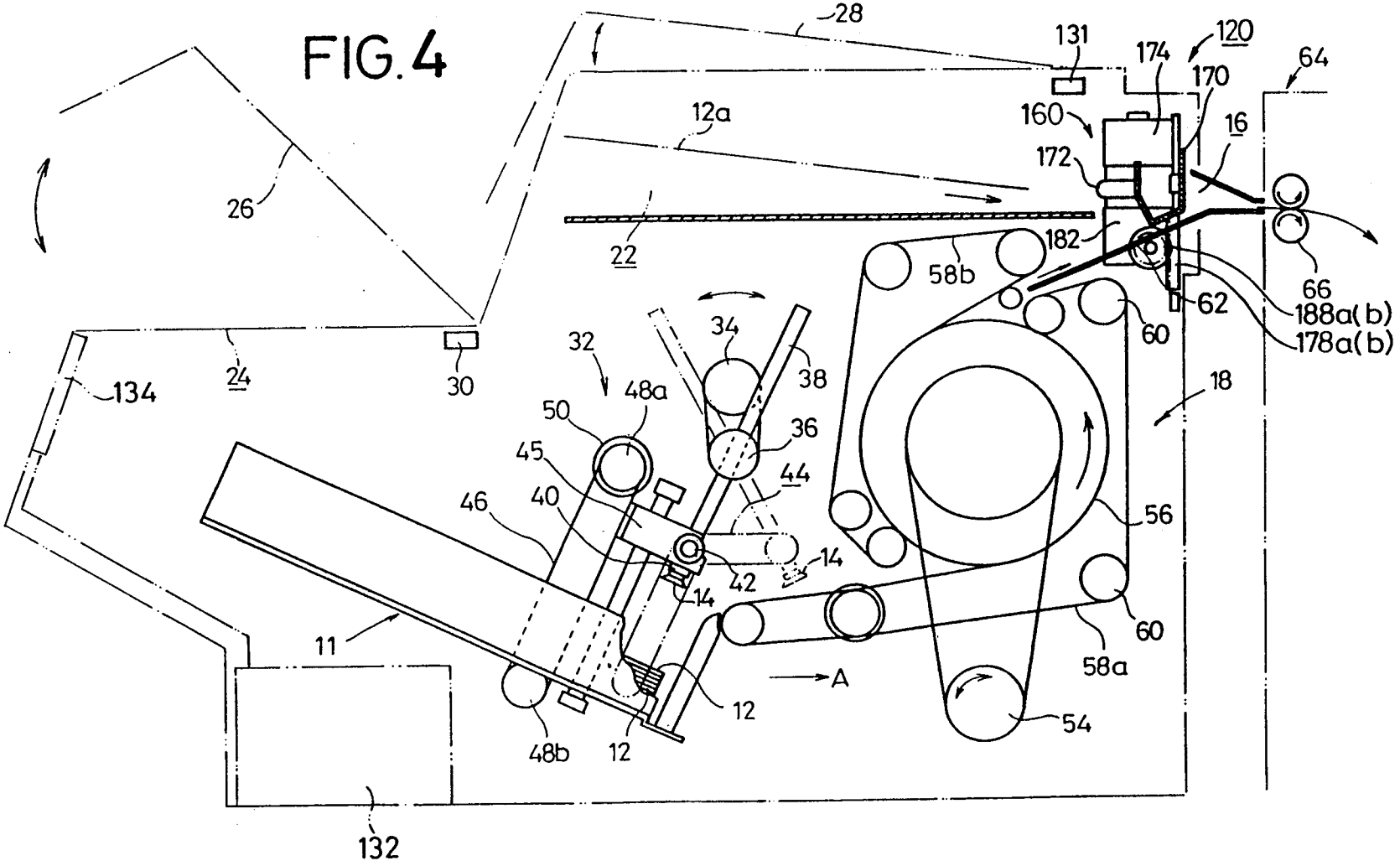
FIG. 4 is a view schematically illustrating the structure of a sheet feeding device according to a second embodiment of the present invention.

Referring FIG. 4, designated at numeral 120 is a sheet feeding device according to the second embodiment. The sheet feeding device 120 basically comprises a suction cup or pad (sheet separating means) 14 for taking out one by one the stacked photographic light-sensitive mediums (sheets) 12 which have imagewisely been exposed and which are stored in a sheet placement portion or unit 11, a delivering means 18 for delivering the uppermost photographic light-sensitive medium 12 thus taken out to a sheet discharge port, i.e., an outlet 16, a shutter means 160 capable of opening and closing the outlet 16, and a sheet insertion slot 22 for directly introducing another extra photographic light-sensitive medium 12*a* into the outlet 16.

Figure 5:
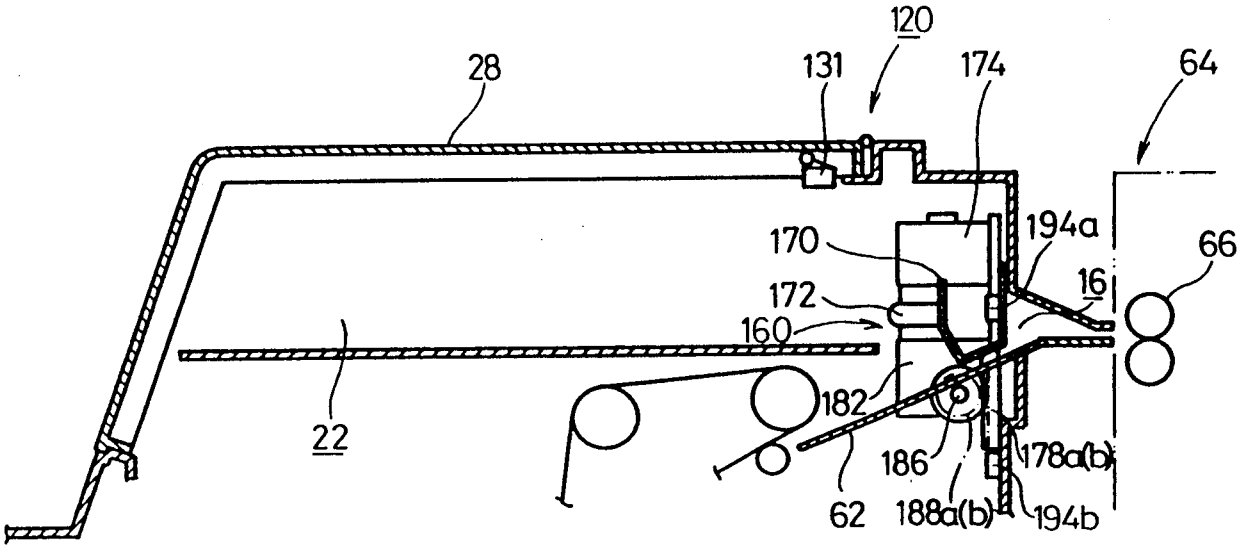
FIG. 5 is a vertical cross-sectional view for showing the operation of the sheet feeding device shown in FIG. 4.
Figure 6:
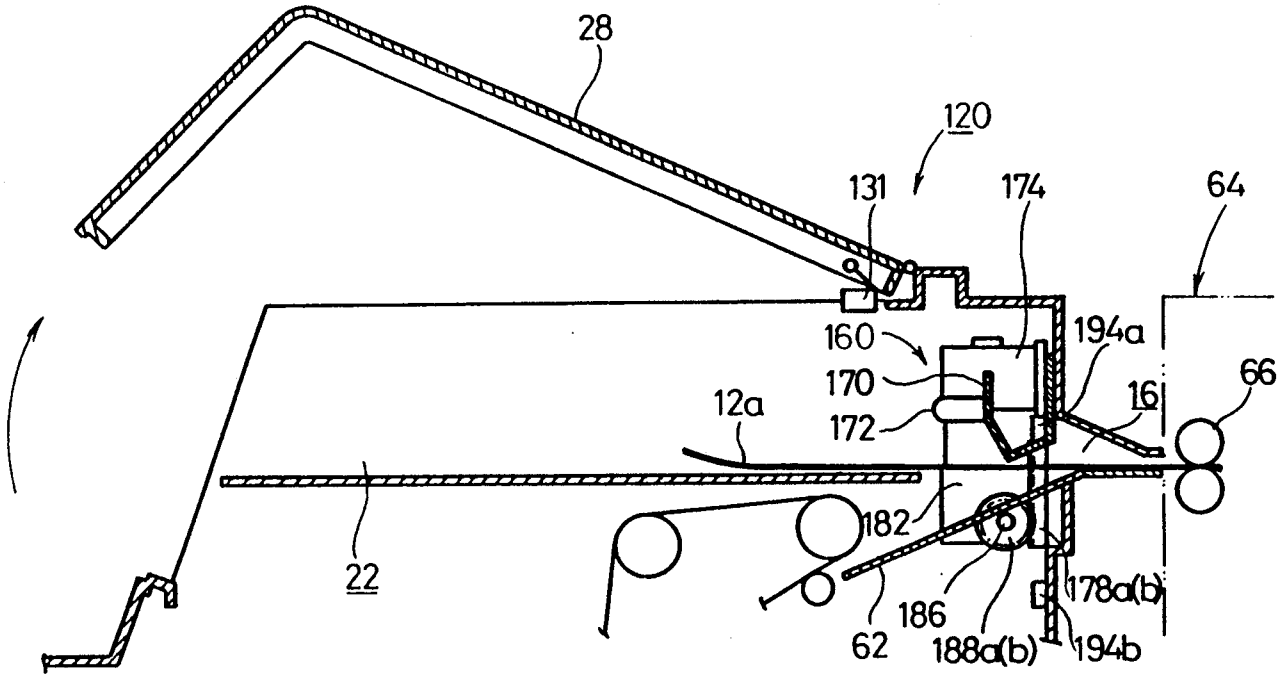
FIG. 6 is a vertical cross-sectional view for showing the other operation of the sheet feeding device shown in FIG. 4.

A first cover 26 (means for opening and closing a sheet loading opening 24) capable of opening and closing the sheet loading opening 24 for loading stacked photographic light-sensitive mediums 12 in the sheet placement unit 11, and a second cover 28 (means for opening and closing the sheet insertion slot 22) capable of opening and closing the sheet insertion slot 22 (see FIGS. 4 through 6) are disposed on the sheet feeding device 120. The same reference numerals as those employed in the first embodiment show the same elements of structure as those used in the first embodiment, and their detailed description will therefore be omitted.

A first detecting switch (loading detecting means) 130 such as a microswitch for detecting whether the first cover 26 is in an opened state or in a closed state is disposed in the vicinity of the first cover 26 for opening and closing the sheet loading opening 24. A second detecting switch (insertion detecting means) 131 such as a microswitch for detecting whether the second cover 28 is in an opened state or in a closed state is also disposed near the second cover 28 for opening and closing the sheet insertion slot 22. The output of each of the first and second detecting switches 130, 131 is supplied to a control unit 132 for actuating the sheet feeding device 120.

If the first detecting switch 130 detects that the first cover 26 has been closed or the second detecting switch 131 detects that the second cover 28 has been closed, then the respective components such as the suction pad 14, the delivering means 18, etc. are actuated in accordance with a drive signal generated from the control unit 132, thereby starting the operation of the sheet feeding device 120.

Then, the residual quantity of the stacked photographic light-sensitive mediums 12 stored in the sheet placement unit 11 is detected based on the quantity of displacement of a movable member 45 from the reference position to a sheet or film drawing position. If the residual quantity of the photographic light-sensitive mediums 12 becomes zero, then the emptiness is displayed on a display unit (displaying means) 134. The residual-quantity detecting means can also be constructed by mounting a vacuum detector on the suction pad 14. In addition, malfunction of feeding operation can be detected by detecting the state of each component and an error is displayed on the display unit 134 or another display unit.

Figure 7:
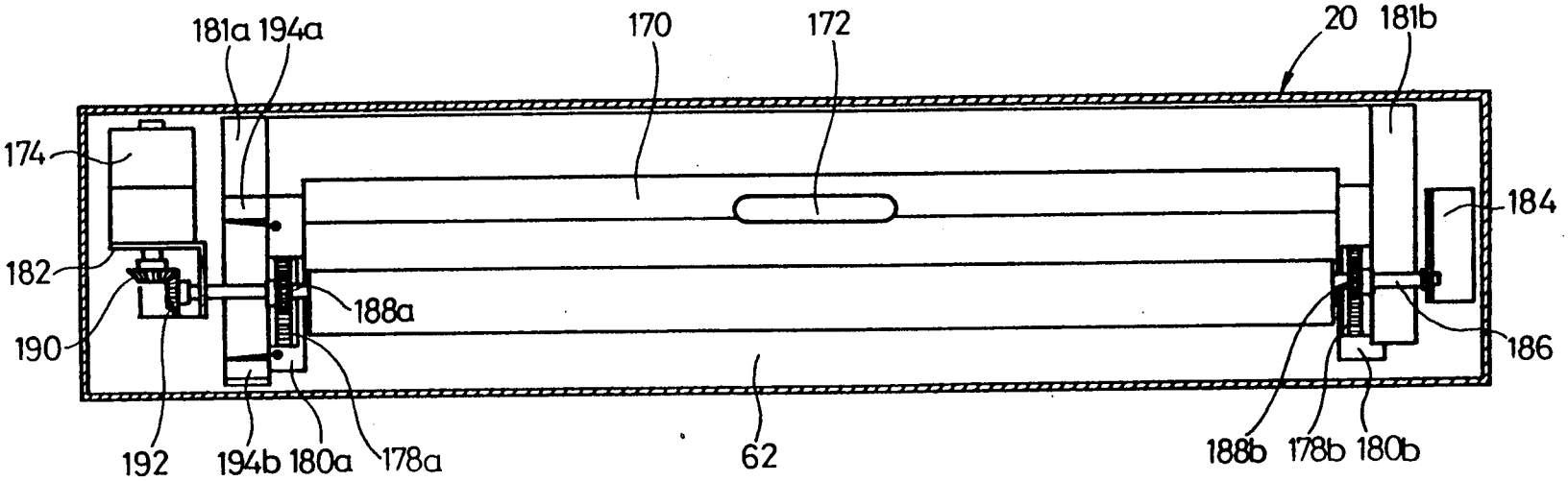
FIG. 7 is a cross-sectional view illustrating the structure of a shutter means employed in the sheet feeding device shown in each of FIGS. 1 and 4.

As shown in FIG. 7, the shutter means 160 includes a control knob or grip 172 attached to a side wall of a shutter plate 170 on the second cover 28 side, and an electric motor (drive source) 174 to move the shutter plate 170 in upward and downward directions. The shutter plate 170 has, at opposite sides thereof, guides 180*a*, 180*b* to which racks 178*a*, 178*b* are attached. The guides 180*a*, 180*b* are supported by support plates 181*a*, 181*b* fixed to the sheet feeding device 120. Limit switches 194*a*, 194*b* for detecting vertical positions of the shutter plate 170 by contacting with the rack 178*a* are attached to the support plate 181*a*.

A first helical gear 190 is mounted on a drive shaft of the motor 174 attached to the sheet feeding device 120 by a bracket 182. A second helical gear 192 meshes with the first helical gear 190. The second helical gear 192 is fixed to one end of a rotatable shaft 186 on which pinions 188*a*, 188*b* respectively mesh with the racks 178*a*, 178*b* are mounted. The both end of rotatable shaft 186 are respectively supported by the bracket 182 and a bracket 184.

The operation of the sheet feeding device 120 constructed as described above will now be described below.

A first cover 26 for opening and closing a sheet loading opening 24 is swung upwardly to open the sheet loading opening 24. Thereafter, a plurality of photographic light-sensitive mediums 12 is loaded in a sheet placement portion or unit 11 through the sheet loading opening 24.

When the first cover 26 is closed, the first detecting switch 130 such as the microswitch is actuated to detect that the first cover 26 is closed. Then, the respective components such as the suction pad 14, the delivering means 18, etc. are actuated by the drive signal generated from the control unit 132 for actuating the sheet feeding device 120 to start the sheet feeding operation by the suction pad 14, thus the sheet feeding device 120 automatically starts the operation. The operation for feeding the stacked photographic light-sensitive mediums 12 stored in the sheet placement unit 11 toward the outlet 16 is similar to that in the sheet feeding device 10, and its detailed description will therefore be omitted.

When the uppermost photographic light-sensitive medium 12 is delivered to the outlet 16 along a guide plate 62, the shutter plate 170 facing the outlet 16 is moved upwards by the pinions 188*a*, 188*b* and the racks 178*a*, 178*b* to open the outlet 16. The limit switch 194*a* detects that the outlet 16 has been opened by the shutter plate 170. Accordingly, the photographic light-sensitive medium 12 is delivered from the outlet 16 to an automatic photographic processor 64.

After the uppermost photographic light-sensitive medium 12 has been fed to the automatic photographic processor 64 from the sheet feeding device 120, the shutter plate 170 is moved downwards and closes the outlet 16 by displacing the racks 178*a*, 178*b* by the rotation of the motor coupled via the first and second helical gears 190, 192 to the rotatable shaft 186 in the reverse direction. As a result, the invasion of gas produced in the automatic photographic processor 64 into the sheet feeding device 120 can be prevented by the shutter plate 170, the closure of the shutter plate 170 being detected by the limit switch 194*b*.

When stacked photographic light-sensitive mediums 12 are being picked up and fed one by one by the suction pad 14, the residual quantity of the stacked photographic light-sensitive mediums 12 is detected by a residual-quantity detecting means based on the quantity of displacement of a movable member 45 from the reference position to a sheet drawing position. If the residual quantity of the photographic light-sensitive mediums 12 reaches zero, then the emptiness is displayed on a display unit 134. Thereafter, an operator opens the first cover 26 to load new stacked photographic light-sensitive mediums 12 in the sheet placement unit 11, and then closes the first cover 26. When the first detecting switch 130 detects that the first cover 26 is closed, the operation of the sheet feeding device 120 can be restarted in response to a drive signal from the control unit 132.

If failures, or malfunctions occur, such as clogging or double-sheet feeding of the photographic light-sensitive mediums 12, by detecting the state of each component in the sheet feeding device 120, in the same manner as described above, an error is displayed on the display unit 134. The operator opens the first cover 26 to remove the photographic light-sensitive mediums 12 subjected to such malfuctions and then closes the first cover 26. When the first detecting switch 130 detects that the first cover 26 is closed, the operation of the sheet feeding device 120 is restarted by a drive signal from the control unit 132.

While stacked photographic light-sensitive mediums 12 stored in the sheet placement unit 11 are being fed one by one to the automatic photographic processor 64 by the suction pad 14 and the delivering means 18, urgent processing of an extra photographic light-sensitive mediums 12*a* may be required.

In such event, a drive means 32 and the delivering means 18 are inactivated, and thereafter the second cover 28 is swung upwardly to open the sheet insertion slot 22, the shutter plate 170 is lifted to open the outlet 16 by the rotation of rotatable shaft 186 by the action of the motor 174. Then, the photographic light-sensitive medium 12*a* is inserted into the sheet feeding device 120 through the sheet insertion slot 22, and the leading end of the photographic light-sensitive medium 12 is directly inserted into the outlet 16 (see FIG. 6). Therefore, the leading end of the photographic light-sensitive medium 12*a* is held between transporting rollers 66 in the automatic photographic processor 64, and thereafter the transporting rollers 66 are rotated to feed the photographic light-sensitive medium 12*a* to a developing process station.

When the second cover 28 for the opening and closing of the sheet insertion slot 22 is closed, the second detecting switch 131 such as the microswitch is operated to detect that the second cover 28 is closed. Thus, the operation of the sheet feeding device 120 automatically is restarted in response to the drive signal from the control unit 132 for actuating the sheet feeding device 120.

When the shutter means 160 becomes inoperable due to failure of, for example, the motor 174, the limit switches 194*a*, 194*b*, etc. the operator lifts the second cover 28 and grips a control knob or grip 172 mounted on the side wall of the shutter plate 170 to manually move the shutter plate 170 upwardly to open the outlet 16. It is therefore possible to feed each of the photographic light-sensitive mediums 12, 12*a* through the slot 22 and the outlet 16 to the automatic photographic processor 64 along the guide plate 62. After the photographic light-sensitive mediums 12*a* have been fed to the automatic photographic processor 64, the operator presses down the grip 172 to bring the shutter plate 170 into close contact with the guide plate 62 to close the outlet 16. Thus, even if the shutter means 160 fails, the photographic light-sensitive medium 12*a* can be fed to the automatic photographic processor 64 through the slot 22 by repeatedly carrying out the operation referred to above.

According to the present embodiment, as described above, even when the sheet feeding device 120 fails, particularly even when the shutter means 160 fails the photographic light-sensitive mediums 12*a* can be smoothly be fed to the automatic photographic processor 64 by manually lifting the shutter plate 170 without actuating the sheet feeding device 120.

In the present embodiment, the rotatable shaft 186 coupled to the motor 174 is rotated to displace the shutter plate 170 in the upward and downward directions for opening and closing the shutter means 160. However, the shutter plate 170 may also be mechanically opened or closed by making use of, for example, a link mechanism or a gear train interlocked with the opening and closing operations of the second cover 28.

After the photographic light-sensitive medium 12*a* has been developed in the above-described manner, when the second cover 28 is closed by the operator and the second detecting switch 131 detects that the second cover 28 is closed, the sheet feeding operation of the suction pad 14 is restarted in response to the drive signal from the control unit 132.

In the present embodiment, as described above, the first cover 26 for opening and closing the sheet loading opening 24 is opened before the sheet feeding device 120 is operate and the stacked photographic light-sensitive mediums 12 is loaded in the sheet placement unit 11. Alternatively, the second cover 28 for opening and closing the sheet insertion slot 22 is opened and the photographic light-sensitive medium 12*a* is inserted into the automatic photographic processor 64.

Then, when the first cover 26 is closed, the first detecting switch 130 detects that the first cover 26 is closed. Alternatively, when the second cover 28 is closed, the second detecting switch 131 detects that the second cover 28 is closed. Thereafter, the control unit 132 is automatically actuated in response to a detection signal from either the first detecting switch 130 or the second detecting switch 131 to start the sheet feeding device 120. Therefore, the operation of the sheet feeding device 120 can be carried out with great ease.

Figure 8:
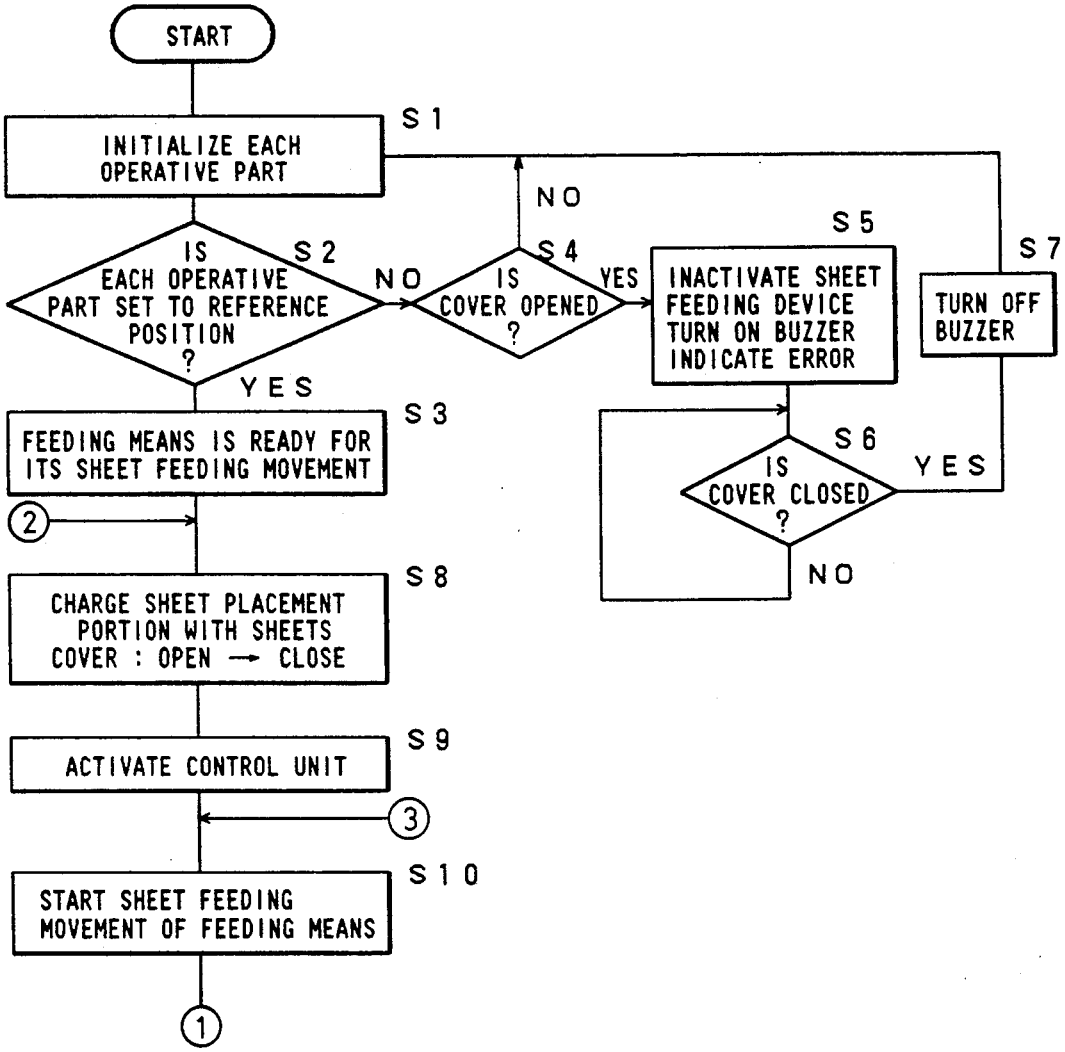
FIGS. 8, 9 and 10 are flowcharts for describing processing sequences of operations of the sheet feeding devices shown in FIGS. 1 and 4.
Figure 9:
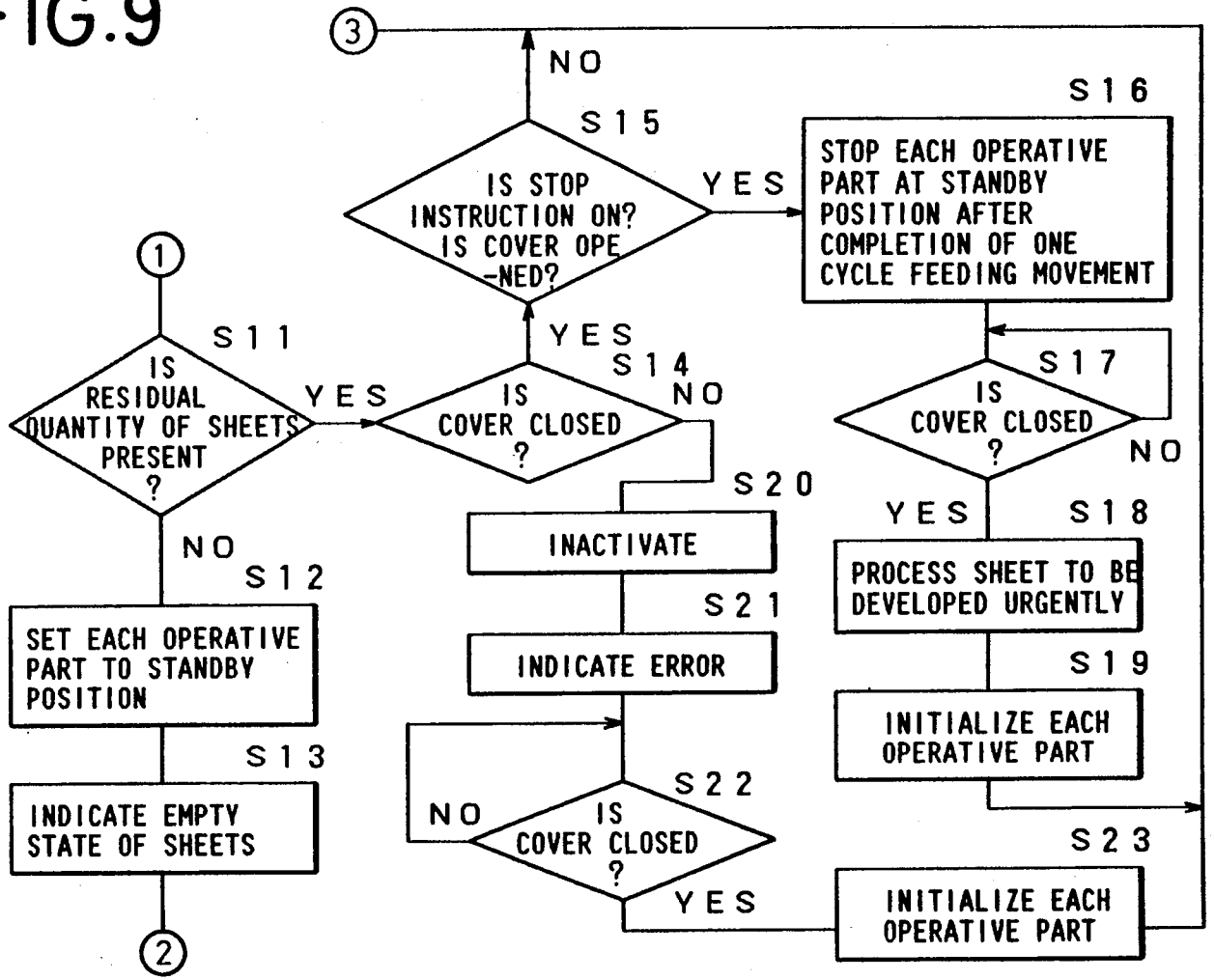
Figure 10:
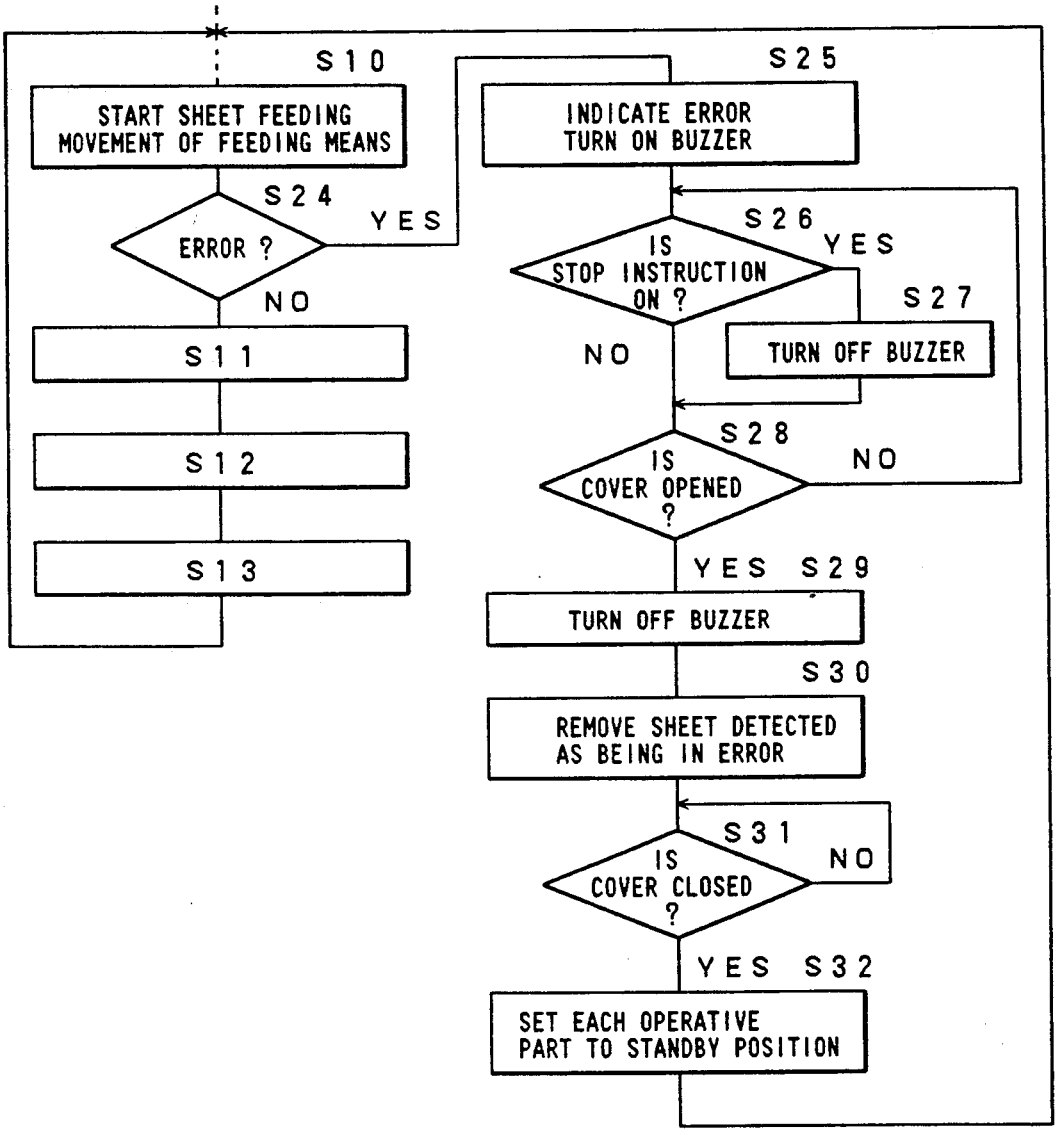

FIGS. 8, 9 and 10 are flowcharts each illustrating the operation of the sheet feeding device 120 according to the present embodiment.

First of all, respective operative component parts of the sheet feeding device 120 are initialized in Step S1. Then, each of the parts is adjusted in Step S2 to the reference position.

If each part is not set to the position, then it is checked in Step S4 whether the first and second covers 26, 28 are in an opened state or in a closed state. If it is determined that they are not opened, then the routine procedure returns to Step S1. If it is determined that they are opened, then the sheet feeding device 120 is deactuated, i.e., stops its operation, so that a buzzer is turned ON and an error message of a cover opened state is displayed (Step S6). Accordingly, the sheet feeding device 120 is placed in the standby state until the first and second covers 26, 28 are closed (Step S5). If it is determined that they are in the closed state, then the buzzer is turned OFF (Step S7), and the routine procedure returns to Step S1.

When the suction pad 14 is ready for its sheet feeding movement in Step S3, stacked photographic light-sensitive mediums 12 are loaded in the sheet placement unit 11 through the sheet loading opening 24 and thereafter the first cover 26 is closed in Step S8. If the first detecting switch 130 detects that the first cover 26 has been brought into the closed state, then the control unit 132 is actuated (Step S9), to start the sheet feeding operation of the suction pad 14 (Step S10).

It is then determined (see (FIG. 9) in Step S11 whether any stacked photographic light-sensitive mediums 12 remain in the sheet placement unit 11. If the stacked photographic light-sensitive mediums 12 are depleted, then each operative component part is stopped at a standby position in Step S12 and the condition is displayed in Step S13. If new stacked photographic light-sensitive mediums 12 are set in the sheet placement unit 11, then the routine procedure returns to Step S8.

If photographic light-sensitive mediums 12 remain, it is checked in Step S14, whether the first cover 26 is opened or closed. If the cover 26 is determined that it is closed, then it is checked in Step S15 whether or not the second cover 28 is opened or closed and whether or not a stop instruction shows an ON state. If it is judged that the second cover 28 is in the closed state and the stop instruction does not show the ON state, then the routine procedure returns to Step S10, where the sheet feeding operation from stacked photographic light-sensitive mediums 12 is started. By repeating the above procedure, the stacked photographic light-sensitive mediums 12 are fed one by one by the suction pad 14.

In Step S15, the stop instruction shows the ON state or the second cover 28 is brought into the opened state in order to expedite the processing of an extra sheet, each operative part being stopped at a standby position after completion of one cycle of feeding a photographic light-sensitive medium 12 from the sheet placement unit 11 in Step S16, a photographic light-sensitive medium 12*a* being inserted through the sheet insertion slot 22. When the second cover 28 is brought into the closed state (Step S17) expedited sheet processing is performed in Step S18.

In the present embodiment, each operative part is stopped at the standby position at the time when one cycle of feeding operation is completed. However, the timing may be adjusted after a photographic light-sensitive medium 12 has been fed into either the delivering means 18 or the automatic photographic processor 64.

When the expedited sheet developing process has been completed in Step S18, each operative part is initialized in Step S19. Thereafter, the routine procedure returns to Step S10, where a process for feeding stacked light-sensitive mediums 12, one, by one is repeatedly performed.

Alternatively, if it is determined in Step S14 that the first cover 26 is in the opened state, then the sheet feeding device 120 is deactuated (Step S20) and an error indication is displayed on the display unit 134 in Step S21. It is then checked (in Step S22) whether or not the first cover 26 is opened or closed. If it is determined that the first cover 26 is closed, then each operative part is initialized in Step S23. Thereafter, the routine procedure returns to Step S10, where the process for feeding the stacked photographic light-sensitive mediums 12, one by one, is repeatedly performed.

As shown in FIG. 10, when the sheet feeding operation by the suction pad 14 is carried out in Step S10, it is then checked in Step S24 whether or not a malfunction has occurred in the sheet feeding operation. If a malfunction has occurred, then an error indication is displayed and a buzzer is turned ON in Step S25. If a stop instruction is in the ON state in Step S26, then the buzzer is turned OFF (Step S27). If a stop instruction is not given, then the buzzer remains ON. When the first cover 26 is brought into the opened state in Step S28, the buzzer is turned OFF (Step S29). Then, a photographic light-sensitive medium 12 which may be causing the malfunction is removed (Step S30). If it is determined in Step S31 that the first cover 26 is closed, then each operative part is adjusted so as to be set to a standby position (Step S32). Thereafter, the routine procedure returns to Step S10, where the process for feeding the stacked photographic light-sensitive mediums 12 one by one is repeatedly performed.

If it is determined to be negative in Step S24, then the routine procedure proceeds to Steps S11 through S13 shown in FIGS. 9 and 10, or Steps S14 and S15 shown in FIG. 9, and the stacked photographic light-sensitive mediums 12 are continuously fed, one by one.

The above processes are performed by the illustrated microprocessor 132 (FIG. 4) to which information of the state of each operative part of the sheet feeding device 120 and the signals generated from the detecting means are input. Thus, this microprocessor 132 may be constructed so that the processes are carried out based on control programs of the processing sequences shown in FIGS. 8, 9 and 10, and a predetermined control signal is then supplied to each operative part of the sheet feeding device 120 to control its operation.

Figure 11:
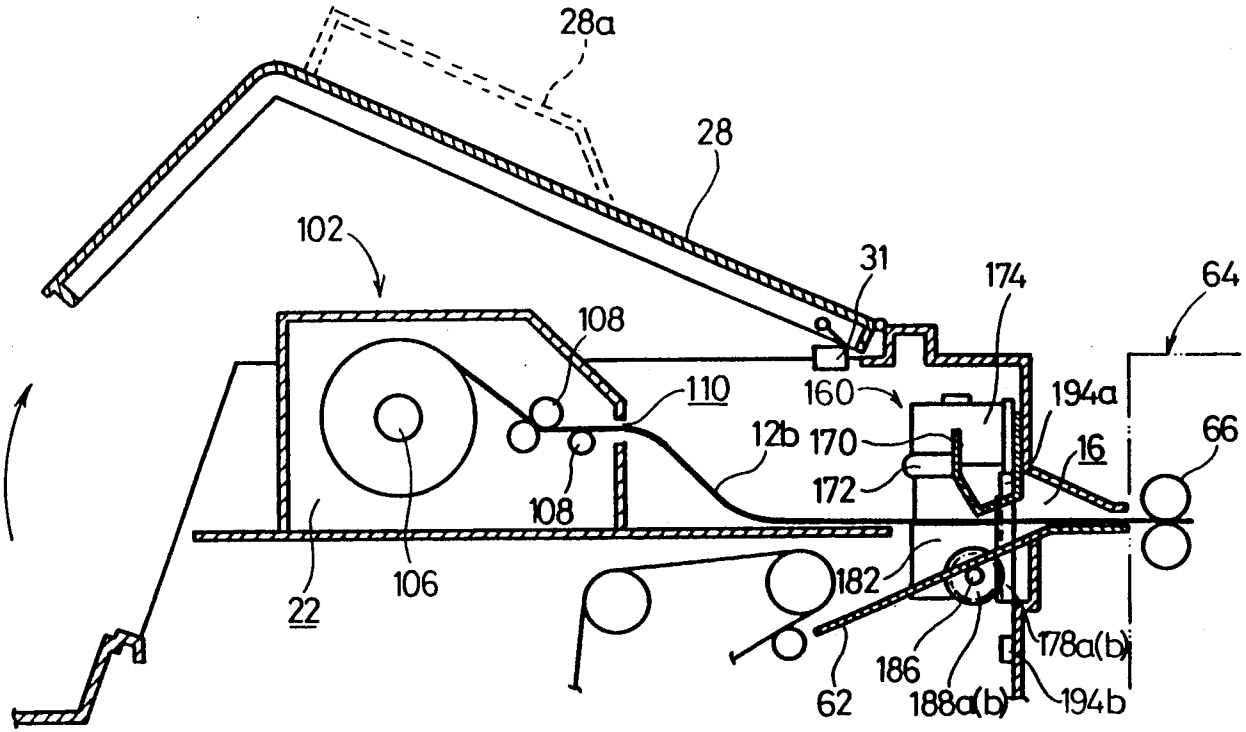
FIG. 11 is a cross-sectional view illustrating the structure of an essential part of a modification of the sheet feeding device according to the second embodiment.

In the present embodiment, the sheet-like photographic light-sensitive medium 12*a* is used as the sheet placed outside the sheet feeding device 10. However, a roll of photographic light-sensitive medium 12*b* shown in FIG. 11 may also be used. In such case, the same reference numerals as those shown in FIG. 3 show the same elements of structure as those depicted in FIG. 3 and, according, need not be described in detail herein.

Figure 12:
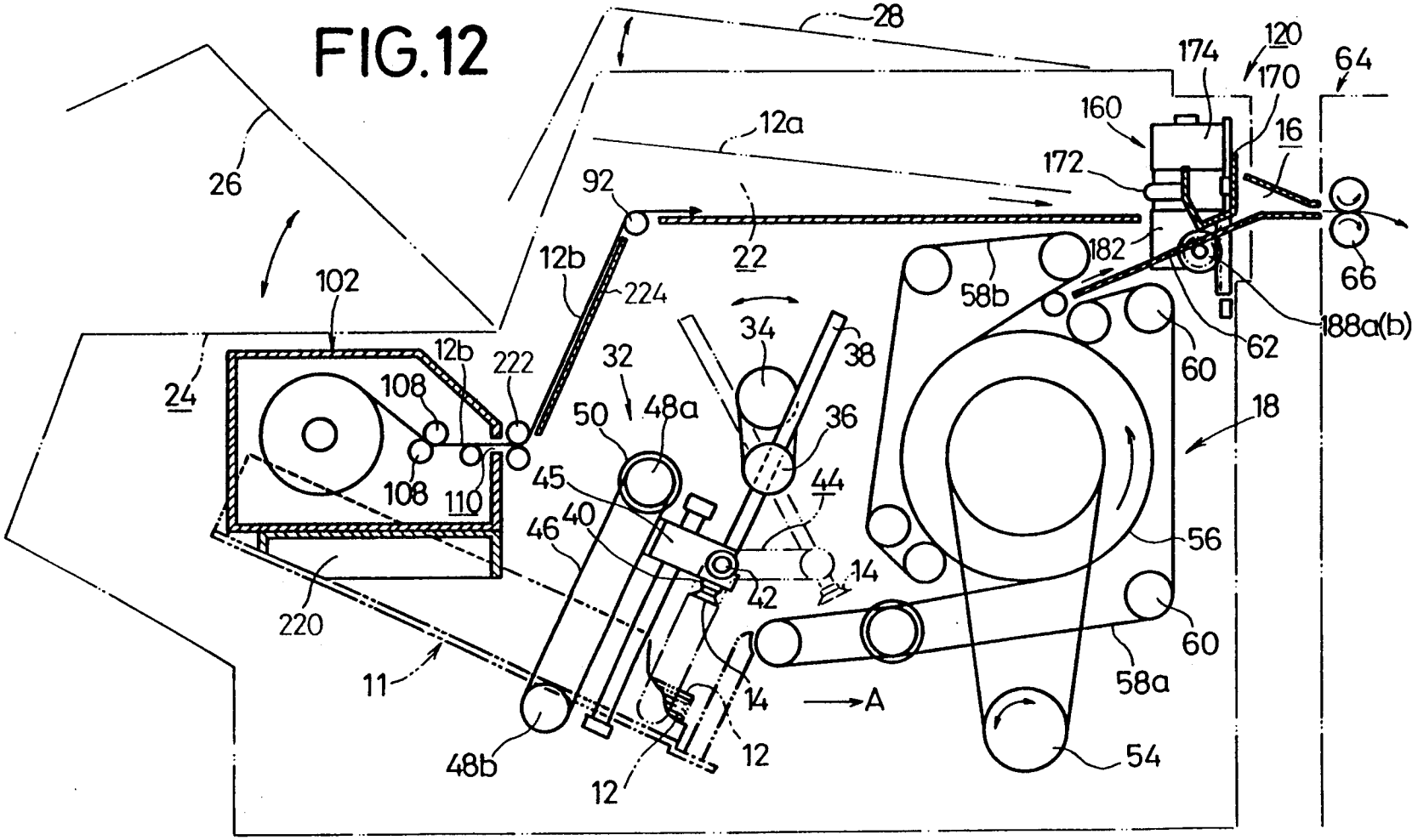
FIG. 12 is a schematic view showing the structure of an essential part of another modification of the sheet feeding device according to the second embodiment.

FIG. 12 shows another embodiment of a sheet feeding device in which a magazine 102 for a roll film is accommodated.

Referring to FIG. 12, the magazine 102 is placed on the magazine support table 220 in a sheet placement unit 11 when a first cover 26 is opened. Then, the leading end of a roll of photographic light-sensitive medium 12*b* is interposed between a pair of light-shielding rollers 108 and then drawn through an opening 110 and interposed between a pair of rollers 222.

When a second cover 28 is opened, the leading end of the roll of the photographic light-sensitive medium 12*b* is guided along a guide plate 224 and then interposed between a pair of delivery rollers 66. Then, when the second cover 28 is closed, the delivery rollers 66 are rotated to feed the photographic light-sensitive medium 12 into an automatic photographic processor 64.

The sheet feeding device according to the present invention results in the following advantageous effects.

When it is required to urgently develop an extra sheet while stacked sheets are being fed one by one to an automatic photographic processor or the like by a sheet separating means and a delivery means, the sheet is directly introduced into an outlet from a sheet insertion slot Therefore, the extra sheet developing process can promptly be carried out even when the sheet feeding device is deactuated or fails. As a result, the stacked sheets can smoothly and efficiently be fed one by one.

Further, a shutter means can manually be opened or closed, thereby making it possible to rapidly process each sheet regardless of the state of the sheet feeding device.

The sheet a sheet loading opening or a means for opening and closing a sheet insertion slot is opened, thereafter either the sheet loading opening or the sheet insertion slot is closed after a sheet stack is loaded in place through the sheet loading opening or after an extra sheet is inserted into an outlet through the sheet insertion slot. Thus, either a loading detecting means or an insertion detecting means may be used to detect either that the sheet loading opening or the sheet insertion slot is closed, respectively. As a result, the sheet feeding device automatically starts to operate in response to an output detected by either the loading detecting means or the insertion detecting means. Accordingly, an operator can avoid trouble in starting the sheet feeding device, thereby making it possible to greatly simplify the operation of the sheet feeding device.

In case new stacked sheets are introduced from a sheet loading opening after all the remaining stacked sheets have been taken out from a sheet placement portion and the sheet feeding device is then operated again, or in case malfunctions such as clogging or sheets, of double sheet feeding occur during sheet feeding operation by a sheet separating means, all the sheets causing such malfunctions are removed, and the sheet feeding device is restarted automatically.

Having now fully described the invention, it will be apparent to those skilled in the art that many changes and modifications can be made without departing from the spirit or scope of the invention as set forth herein.

What is claimed is:

1. A sheet feeding device for feeding sheets one by one, said device comprising:

sheet separating means for removing an uppermost sheet of a plurality of stacked sheets stored in a sheet placement unit;

means for delivering said uppermost sheet to a sheet discharge port;

shutter means for opening and closing said sheet discharge port; and a sheet insertion slot for introducing an extra sheet, other than said plurality of stacked sheets, directly into said sheet discharge port, and wherein said shutter means comprises:

a grip mounted on said shutter plate, for manually displacing said shutter plate, a drive source for automatically displacing said shutter plate, and means for transmitting a driving force produced by said drive source to said shutter plate to thereby open and close said sheet discharge port.

2. A device according to claim 1, wherein said transmitting means comprises a pair of pinions coupled to said drive source, and a pair of racks meshing with said pinions and fixed to said shutter plate.

3. A device according to claim 1, further comprising a cover for covering said sheet insertion slot.

4. A device according to claim 1, further comprising a magazine for accommodating a roll of sheets, said magazine being removably disposed in a vicinity of said sheet insertion slot.

5. A device according to claim 1, further comprising a magazine for accommodating a roll of sheets, said magazine being removably disposed in said sheet placement unit.

6. A sheet feeding device for feeding sheets one by one, said device comprising:

a sheet loading opening through which a plurality of stacked sheets are loaded in a sheet placement unit;

sheet separating means, including a pivotally mounted suction device, for removing an uppermost sheet of said plurality of stacked sheets from said sheet placement unit;

means for delivering said uppermost sheet to a sheet discharge port;

shutter means for opening and closing said sheet discharge port;

a sheet insertion slot for introducing an extra sheet, other than said plurality of stacked sheets, directly into said sheet discharge port;

a cover for covering said sheet loading opening;

loading detecting means for detecting whether said cover is opened or closed; and a control unit for actuating said sheet feeding device when said loading detecting means detect that said cover is closed.

7. A sheet feeding device according to claim 6, further including display means for displaying an error when malfunctions in the sheet feeding operation are detected.

8. A sheet feeding device according to claim 6, further including means for detecting a residual quantity of stacked sheets loaded in said sheet placement unit, and means for indicating when said residual quantity is depleted.

9. A sheet feeding device for feeding sheets one by one, said device comprising:

a sheet loading opening through which a plurality of stacked sheets are loaded in a sheet placement unit;

sheet separating means for removing an uppermost sheet of said plurality of stacked sheets from said sheet placement unit;

means for delivering said uppermost sheet to a sheet discharge port;

shutter means for opening and closing said sheet discharge port;

a sheet insertion slot for introducing an extra sheet, other than said plurality of stacked sheets, directly into said sheet discharge port;

a cover for covering said sheet insertion slot;

insertion detecting means for detecting whether said cover is opened or closed; and a control unit for actuating said sheet feeding device when said insertion detecting means detects that said cover is closed.

10. A sheet feeding device for feeding sheets one by one, said device comprising:

a sheet loading opening through which a plurality of stacked sheets are loaded in a sheet placement unit;

sheet separating means for removing an uppermost sheet of said plurality of stacked sheets from said sheet placement unit;

means for delivering said uppermost sheet to a sheet discharge port;

shutter means for opening and closing said sheet discharge port;

a sheet insertion slot through which an extra sheet, other than said plurality of stacked sheets, is directly introduced to said sheet discharge port;

a removable, first cover for covering said sheet loading opening and a removable, second cover for covering said sheet insertion slot;

loading detecting means for detecting whether said first cover is open or closed;

insertion detecting means for detecting whether said second cover is open or closed; and a control unit for actuating said sheet feeding device when said loading detecting means and said insertion detecting means detect that said first and second covers are closed.

11. A device according to claim 10, further comprising means for placing said sheet feeding device in a standby state when at least one cycle of a sheet feeding operation has been completed, when urgent sheet processing is required or when said insertion detecting means detects that said second cover is open while the plurality of stacked sheets stored in said sheet placement unit are being feed one by one.

12. A sheet feeding device for feeding sheets one by one, said device comprising:

sheet separating means for removing an uppermost sheet of a plurality of stacked sheets stored in a sheet to a sheet discharge port;

shutter means for opening and closing said sheet discharge port;

a sheet insertion slot for introducing an extra sheet, other than said plurality of stacked sheets, directly into said sheet discharge port; and a swingable plate and a drive source, wherein one end of said swingable plate is coupled to said drive source, and an opposite end thereof is engaged with said shutter means for opening and closing said sheet discharge port.

13. A device according to claim 12, further comprising a sensor for detecting angular positions of said swingable plate.

14. A sheet feeding device as recited in claim 12, wherein said sheet separating means comprises a pivotally mounted suction device for removing said uppermost sheet of said plurality of stacked sheets.

* * * * *

UNITED STATES PATENT AND TRADEMARK OFFICE

CERTIFICATE OF CORRECTION

PATENT NO. : 5,253,855

DATED : October 19, 1993

INVENTOR(S) : Nobuyuki Torisawa; Norikazu Soga

It is certified that error appears in the above-indentified patent and that said Letters Patent is hereby corrected as shown below:

In claim 1, at column 14, line 21, before "a" insert --a shutter plate,--,

Signed and Sealed this

Thirty-first Day of May, 1994

Bruce Lehman

*Attest:*

BRUCE LEHMAN

*Attesting Officer*

*Commissioner of Patents and Trademarks*